US008806838B2

(12) United States Patent
Shin

(10) Patent No.: US 8,806,838 B2
(45) Date of Patent: Aug. 19, 2014

(54) LIGHTWEIGHT STONE INSULATING PANEL AND CONSTRUCTION METHOD FOR INSULATING BUILDING EXTERIOR USING THE SAME

(71) Applicant: Daebo Housing Co., Ltd., Dongducheon-si (KR)

(72) Inventor: Seon Ho Shin, Dongducheon-si (KR)

(73) Assignee: Daebo Housing Co., Ltd, Dongducheon-si, Gyeonggi-do (KR)

( * ) Notice: Subject to any disclaimer, the term of this patent is extended or adjusted under 35 U.S.C. 154(b) by 0 days.

(21) Appl. No.: 13/981,215

(22) PCT Filed: Nov. 7, 2012

(86) PCT No.: PCT/KR2012/009322

§ 371 (c)(1),
(2), (4) Date: Jul. 23, 2013

(87) PCT Pub. No.: WO2014/027723

PCT Pub. Date: Feb. 20, 2014

(65) Prior Publication Data

US 2014/0053496 A1 Feb. 27, 2014

(30) Foreign Application Priority Data

Aug. 17, 2012 (KR) ..... 10-2012-0090225

(51) Int. Cl.
*E04B 1/00* (2006.01)
*E04B 1/62* (2006.01)
*E04B 1/04* (2006.01)

(52) U.S. Cl.
CPC .... *E04B 1/04* (2013.01); *E04B 1/62* (2013.01)
USPC ..... 52/745.12; 52/235; 52/506.05; 52/513

(58) Field of Classification Search
CPC ..... E04F 13/0855; E04F 13/0803; E04F 13/0846; E04F 13/083; E04F 13/0805; E04F 13/0807; E04F 13/144
USPC ..... 52/745.12, 741.4, 511, 235, 506.05, 52/506.06, 506.08, 509, 513
See application file for complete search history.

(56) References Cited

U.S. PATENT DOCUMENTS 1,052,670 A * 2/1913 Francis ..... 52/509
2,166,096 A * 7/1939 Kotrbaty ..... 52/481.1
2,202,783 A * 5/1940 Morrell ..... 52/475.1
3,113,358 A * 12/1963 Zell et al. ..... 312/263
3,342,005 A * 9/1967 Rickards et al. ..... 52/702
3,350,830 A * 11/1967 Smith, Jr. et al. ..... 52/509

(Continued)

*Primary Examiner* — William Gilbert
*Assistant Examiner* — James Ference
(74) *Attorney, Agent, or Firm* — Sherr & Jiang, PLLC

(57) ABSTRACT

A construction method for insulating a building exterior. The method includes fixing an L-shaped anchor provided with a vertical portion and a horizontal portion on a building exterior wall, fixing a bracket, and fixing a plurality of lightweight stone insulating panels. The bracket includes a horizontal support portion, an upward fixing portion bent upward from the horizontal support portion, a downward fixing portion bent downward from the horizontal support portion, and an extending support portion extending forward from the horizontal support portion to the L-shaped anchor. The lightweight stone insulating panels includes an insulating board, a stone plate attached to a front surface of the insulating board, and a reinforcing board attached to a rear surface of the insulating board to the building exterior wall. The stone plate is supported by the extending support portion.

4 Claims, 7 Drawing Sheets

(56) References Cited

U.S. PATENT DOCUMENTS

| | | | | | |
|---|---|---|---|---|---|
| 3,646,715 | A | * | 3/1972 | Pope | 52/309.9 |
| 3,775,916 | A | * | 12/1973 | Bair | 52/125.4 |
| 4,107,887 | A | * | 8/1978 | Wendt | 52/105 |
| 4,224,773 | A | * | 9/1980 | Schworer | 52/315 |
| 4,307,551 | A | * | 12/1981 | Crandell | 52/235 |
| 4,448,007 | A | * | 5/1984 | Adams | 52/489.2 |
| 4,498,272 | A | * | 2/1985 | Adams | 52/714 |
| 4,674,250 | A | * | 6/1987 | Altizer | 52/309.7 |
| 4,703,604 | A | * | 11/1987 | Muller | 52/741.4 |
| 4,782,642 | A | * | 11/1988 | Conville | 52/770 |
| 5,207,042 | A | * | 5/1993 | Molinar | 52/293.1 |
| 5,265,396 | A | * | 11/1993 | Amimoto | 52/745.12 |
| 5,313,760 | A | * | 5/1994 | Tojo | 52/747.12 |
| 5,379,561 | A | * | 1/1995 | Saito | 52/235 |
| 5,390,468 | A | * | 2/1995 | Probst | 52/793.1 |
| 5,544,461 | A | * | 8/1996 | Sommerstein | 52/235 |
| 5,619,834 | A | * | 4/1997 | Chen | 52/509 |
| 5,657,593 | A | * | 8/1997 | Eriksen | 52/235 |
| 5,673,529 | A | * | 10/1997 | Treister et al. | 52/511 |
| 5,956,910 | A | * | 9/1999 | Sommerstein et al. | 52/235 |
| 5,992,112 | A | * | 11/1999 | Josey | 52/309.8 |
| 6,098,364 | A | * | 8/2000 | Liu | 52/506.08 |
| 6,725,619 | B1 | * | 4/2004 | Barber | 52/712 |
| 7,735,292 | B2 | * | 6/2010 | Massie | 52/742.14 |
| 7,849,651 | B2 | * | 12/2010 | Fujito et al. | 52/506.06 |
| 7,854,099 | B2 | * | 12/2010 | Kidd | 52/489.1 |
| 8,341,901 | B2 | * | 1/2013 | Loyd | 52/235 |
| 8,468,765 | B1 | * | 6/2013 | Kim | 52/506.06 |
| 2003/0150179 | A1 | * | 8/2003 | Moreno | 52/235 |
| 2006/0265988 | A1 | * | 11/2006 | Fujito et al. | 52/511 |
| 2008/0256882 | A1 | * | 10/2008 | Kidd | 52/235 |
| 2008/0295450 | A1 | * | 12/2008 | Yogev | 52/783.1 |
| 2010/0229489 | A1 | * | 9/2010 | Riepe | 52/489.2 |
| 2010/0300032 | A1 | * | 12/2010 | Kang | 52/612 |

* cited by examiner

LIGHTWEIGHT STONE INSULATING PANEL AND CONSTRUCTION METHOD FOR INSULATING BUILDING EXTERIOR USING THE SAME

CROSS REFERENCE TO PRIOR APPLICATION

This application is a National Stage Patent Application of PCT International Patent Application No. PCT/KR2012/009322 (filed on Nov. 7, 2012) under 35 U.S.C. §371, which claims priority to Korean Patent Application No. 10-0090225 (filed on Aug. 17, 2012), which are all hereby incorporated by reference in their entirety.

TECHNICAL FIELD

The present invention relates to a lightweight stone insulating panel and a construction method for insulating a building exterior using the same, in which an insulating board and a reinforcing board are integrally formed in a stone plate, so that the construction work is simple as a stone plate attaching process and an insulating process can be carried out all at once, and the stone plate can be prevented from falling from the building exterior wall even if the insulating board is completely destroyed by fire.

BACKGROUND ART

Natural or artificial stone plates are widely used to decorate the exterior of a building. Usually, because a stone plate has poor heat insulation, an insulating process is carried out separately. That is, during construction of a building exterior wall, an insulating board is attached to the building exterior wall by the adhesives, etc. for heat insulation of the building exterior wall, and the stone plate is fixed on the outside of the insulating board using an L-shaped anchor.

However, in the construction method described above, the insulating process for heat insulation using the insulating board and a stone plate attaching process for an exterior wall finish are carried out separately, and in order to fix the L-shaped anchor on the wall surface, work holes should be formed on the insulating board. Therefore, construction work is complicated thus causing construction costs to increase, and there is a difficulty in construction because the conventional stone plate for a building exterior wall finish is heavy with a thickness of about 3 cm to 5 cm.

DISCLOSURE

Technical Problem

In consideration of the above-mentioned circumstances, it is an object of the present invention to provide a lightweight stone insulating panel which can be easily constructed because a stone plate attaching process and an insulating process can be carried out all at once during building exterior wall finishing by forming the insulating board and reinforcing board integrally on the stone plate.

Another object of the present invention is to provide a construction method for insulating a building exterior, whereby it is possible to prevent the stone plate from falling from the building exterior wall even if the insulating board is completely destroyed by fire during the construction using the afore-described lightweight stone insulating panel.

Technical Solution

In order to accomplish the foregoing objects, there is provided a lightweight stone insulating panel including: an insulating board; a stone plate attached to a front surface of the insulating board; and a reinforcing board attached to a rear surface of the insulating board.

In order to accomplish the foregoing objects, there is provided a construction method for insulating a building exterior using a lightweight stone insulating panel, the construction method including the processes of: fixing an L-shaped anchor provided with a vertical portion and a horizontal portion on a building exterior wall; fixing a bracket including a horizontal support portion, an upward fixing portion bent upward from a front end of the horizontal support portion, a downward fixing portion bent downward from the front end of the horizontal support portion, and an extending support portion extending forward from the front end of the horizontal support portion to the L-shaped anchor; and fixing a plurality of lightweight stone insulating panels including an insulating board, a stone plate attached to a front surface of the insulating board, and a reinforcing board attached to a rear surface of the insulating board to the building exterior wall in a checkered plate array, wherein the upward fixing portion of the bracket is inserted into a lower end portion of the insulating board, and the downward fixing portion of an adjacent bracket is inserted into an upper end portion of the insulating board so that the stone plate is supported by the extending support portion in a checkered plate array.

Advantageous Effects

The lightweight stone insulating panel according to the present invention can be easily constructed because a stone plate attaching process and an insulating process can be carried out all at once during building exterior wall finishing by forming the insulating board and reinforcing board integrally on the stone plate.

The construction method according to the present invention can prevent the stone plate from falling from the building exterior wall even if the insulating board is completely destroyed by fire during the construction using the afore-described lightweight stone insulating panel.

BEST MODE

Hereinafter, a lightweight stone insulating panel and a construction method for insulating a building exterior using the same according to preferred embodiments of the present invention will be described in detail with reference to the accompanying drawings.

Figure 1:
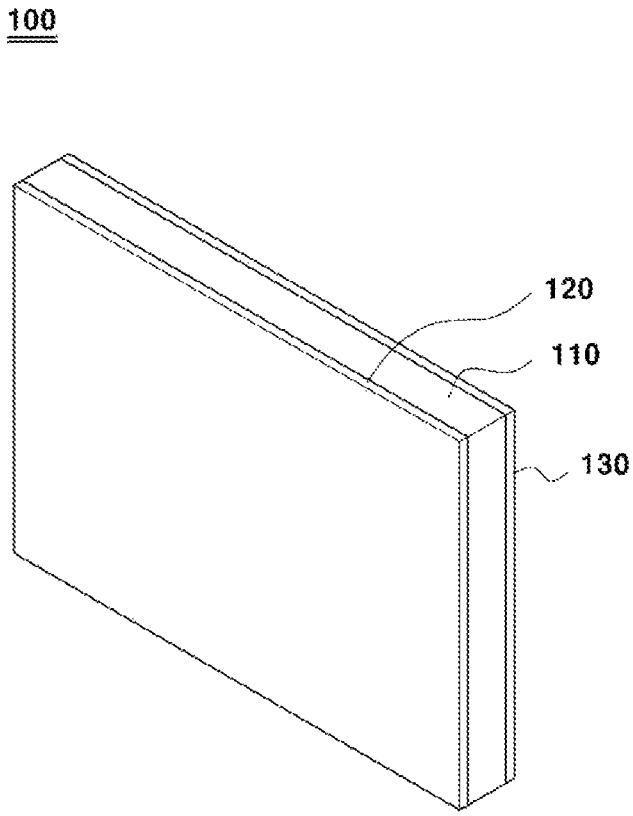
FIG. 1 is a perspective view of a lightweight stone insulating panel according to the present invention.
Figure 2:
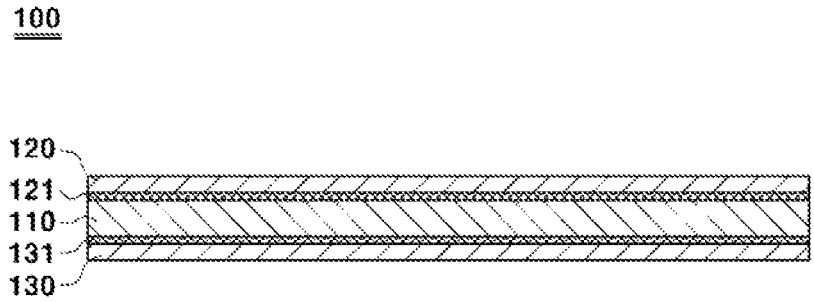
FIG. 2 is a cross sectional view of the lightweight stone insulating panel shown in FIG. 1.

FIG. 1 is a perspective view of a lightweight stone insulating panel according to the present invention, and FIG. 2 is a cross sectional view of the lightweight stone insulating panel shown in FIG. 1.

A lightweight stone insulating panel 100 according to the present invention includes an insulating board 110, a stone plate 120, and a reinforcing board 130.

The insulating board 110 is configured to insulate a building exterior wall, so any material with excellent insulation properties may be used. However, it is preferable that the material of the insulating board 110 be any one selected from EPS, an urethane board, a rock wool board or a glass wool board, so as to be fixed into the fixing piece of the bracket to be described later.

The stone plate 120 is configured to finish the building exterior wall, so it is preferable to use natural stone, but artificial stone may also be used. The stone plate 120 is attached to the front surface of the insulating board 110 with the adhesives, etc. At this time, it is preferable that the stone plate 120 be attached to the insulating board 110 by urethane adhesives 121 with excellent heat insulation properties. Here, since the stone plate 120 is attached on the front surface of the insulating board 110, robustness can be maintained even if it is formed to a thickness of 0.5 cm to 1.5 cm only instead of forming 3 cm to 5 cm thick as conventionally. Therefore, it is possible to provide lightweight panels.

The reinforcing board 130 is a board attached to the rear surface of the insulating board 110 to support the panel, and prevents the panel from being bent due to the change of temperature or elapse of time. Preferably, the material of the reinforcing board 130 is selected from any one of a magnesium board, a cement board or a gypsum board. Further, it is preferable that the reinforcing board 130 is adhered to the insulated board 110 using urethane adhesives 131 with excellent insulation properties.

The lightweight stone insulating panel according to the present invention having the above configuration is constructed more easily than the conventional panel, since an insulating process and a stone plate attaching process can be done all at once without the need of doing them separately, by forming the insulating board 110 and the reinforcing board 130 integrally on the stone plate 120.

Further, since the insulating board 110 and the reinforcing board 130 are provided on the back of the stone plate 120, the thickness of stone plate can be formed thin. Therefore, it is possible to provide a lightweight stone insulating panel.

Hereinafter, a construction method for insulating a building exterior using the above-described lightweight stone insulating panels will be described. A lightweight stone insulating panel could cause a safety accident as it falls because there is no configuration for supporting the stone plate 120 when the insulated board is completely destroyed by fire. Below will be described the construction method for insulating a building exterior whereby the stone plate can be prevented from falling from the building exterior wall even if the insulated board 110 is completely destroyed by fire with reference to the accompanying drawings.

Figure 3:
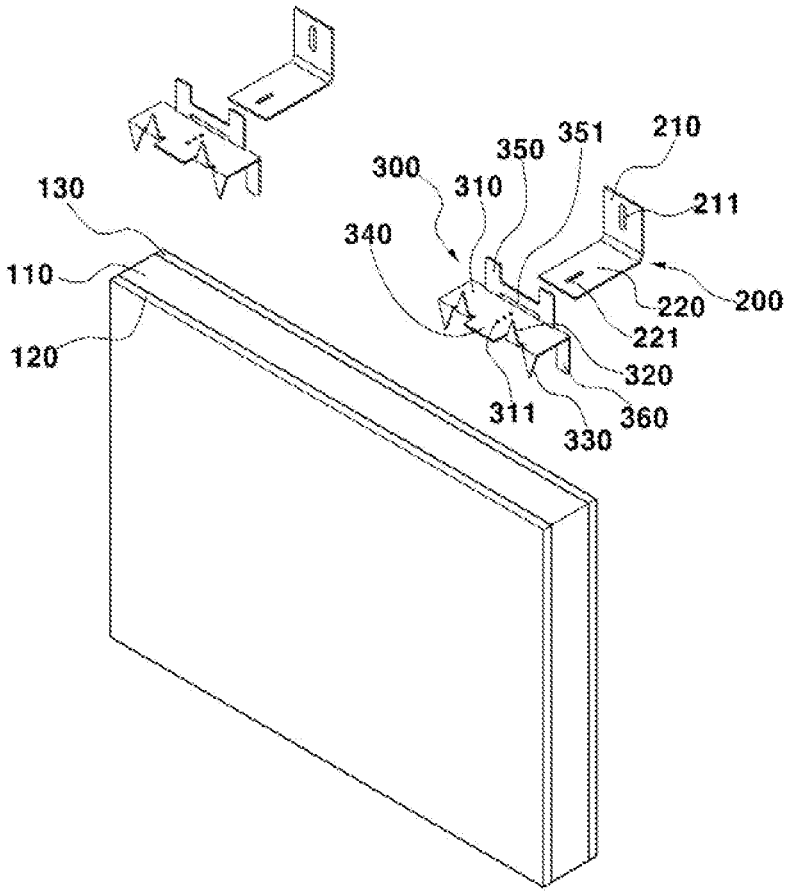
FIG. 3 is an exploded perspective view for describing a construction method for insulating a building exterior according to the present invention.
Figure 4:
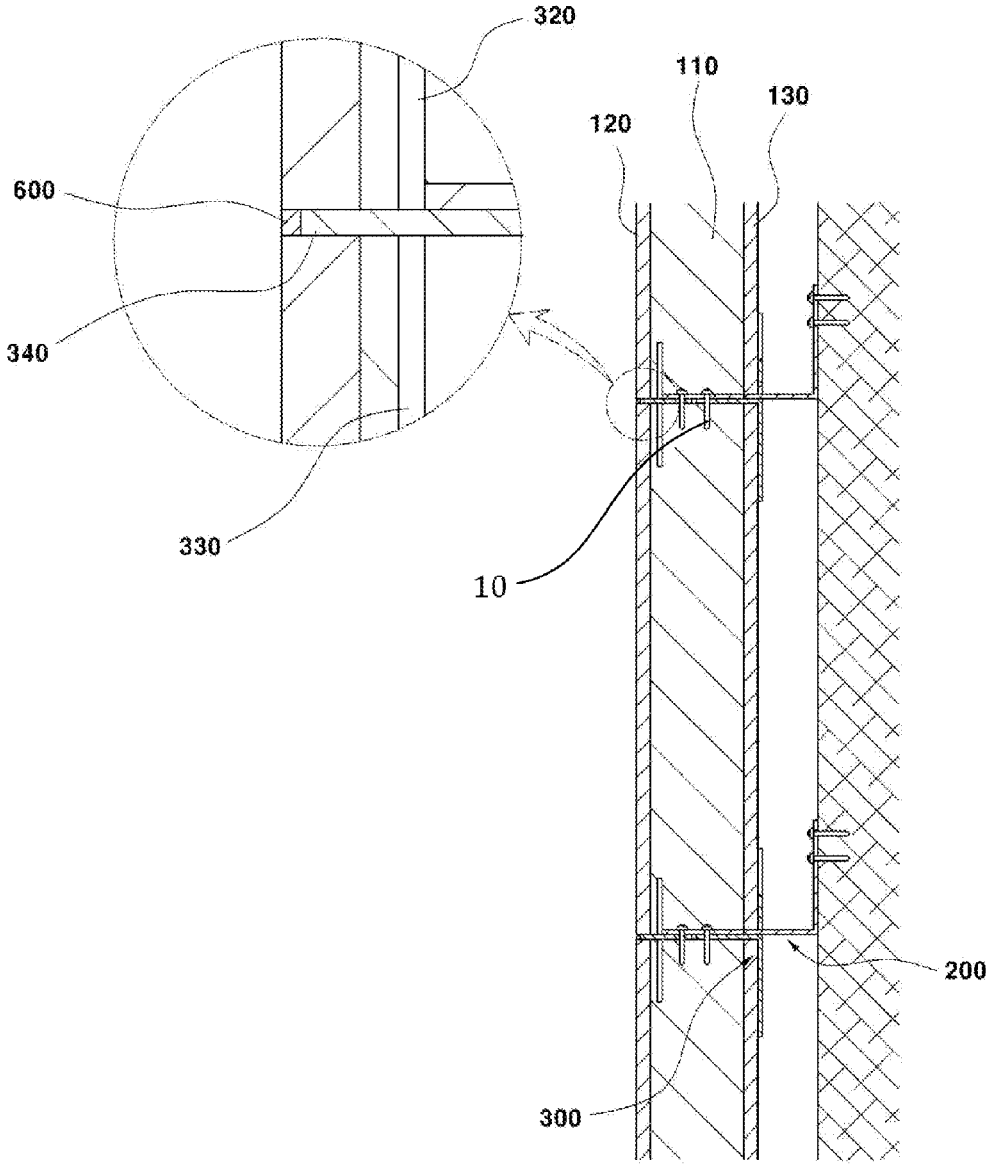
FIG. 4 is a cross sectional view for describing the construction method for insulating a building exterior according to the present invention.

FIG. 3 is an exploded perspective view for describing the construction method for insulating a building exterior according to the present invention, and FIG. 4 is a cross sectional view for describing the construction method for insulating a building exterior according to the present invention.

With reference to drawings, the construction method according to the present invention includes a process of fixing an L-shaped anchor 200 provided with a vertical portion 210 and a horizontal portion 220 on the building exterior wall, as shown in FIGS. 3 and 4. More specifically, the vertical portion 210 of a portion fixed on the building exterior wall is provided with a pin hole 211 into which a pin is inserted to fix the L-shaped anchor 200 to the exterior wall, and the horizontal portion 220 of a horizontal support portion to be described later is provided with a coupling hole 221 into which the pin is inserted.

If the L-shaped anchor 200 is fixed to the building exterior wall by the pin inserted into the coupling hole, the bracket 300 is fixed to the L-shaped anchor 200.

Preferably, the bracket 300 is provided with a horizontal support portion 310, an upward fixing portion 320 bent upward from a front end of the horizontal support portion 310, a downward fixing portion 330 bent downward from the front end of the horizontal support portion 310, and an extending support portion 340 extending forward from the front end of the horizontal support portion 310.

In this case, the upward fixing portion 320 and the downward fixing portion 330 are portions fixed into the insulating board 110 of the stone plate panel, and the extending support portion 340 supports the stone plate 120 even if the insulating board 110 is completely destroyed by fire and is a portion preventing the fall of the stone plate 120.

It is preferable that the bracket 300 further includes an upward support portion 350 and a downward support portion 360. The upward support portion 350 is bent upward at a rear end of the horizontal support portion 310 to support the rear lower end of the reinforcing board 130 of the stone plate. The downward support portion 360 is bent downward at the rear end of the horizontal support portion 310 to support the rear upper end of the reinforcing board 130 of the stone plate. Further, the upward support portion 350 is provided with a slit 351 formed at a lower end thereof so as to have the horizontal portion 220 of the L-shaped anchor 200 inserted therein.

The bracket 300 having the above configuration is fixed to the L-shaped anchor 200, as the horizontal support portion 310 is mounted and coupled to the horizontal portion 220 of the L-shaped anchor. That is, after the horizontal portion 220 of the L-shaped anchor 200 is passed through the slit 351 of the upward support portion 350, a coupling pin (10) is inserted into the coupling hole 221 of the horizontal portion 220 and the coupling hole 311 of the horizontal support portion 310, then the bracket 300 and the L-shaped anchor 200 are fixed to each other.

If the bracket 300 and the L-shaped anchor 200 are fixed to each other as described above, the stone insulating panel according to the present invention is fixed to the bracket 300.

More specifically, after mounting the rear lower end of the reinforcing board 130 on the upward support portion 350 of the bracket 300, the rear upper end of the reinforcing board 130 is supported on the downward support portion 360 of the bracket 300. At the same time, a lower end portion of the insulating board 110 is loaded on the upward fixing portion 320 of the bracket, and an upper end portion of the insulating board 110 is loaded on the downward fixing portion 330 of an adjacent bracket. Thereby, the stone insulating panel is fixed to the bracket 300, and by repeating this work, the stone insulating panels are arrayed like a checkered plate, that is, are constructed consecutively upward, downward, to the left and the right.

Figure 5:
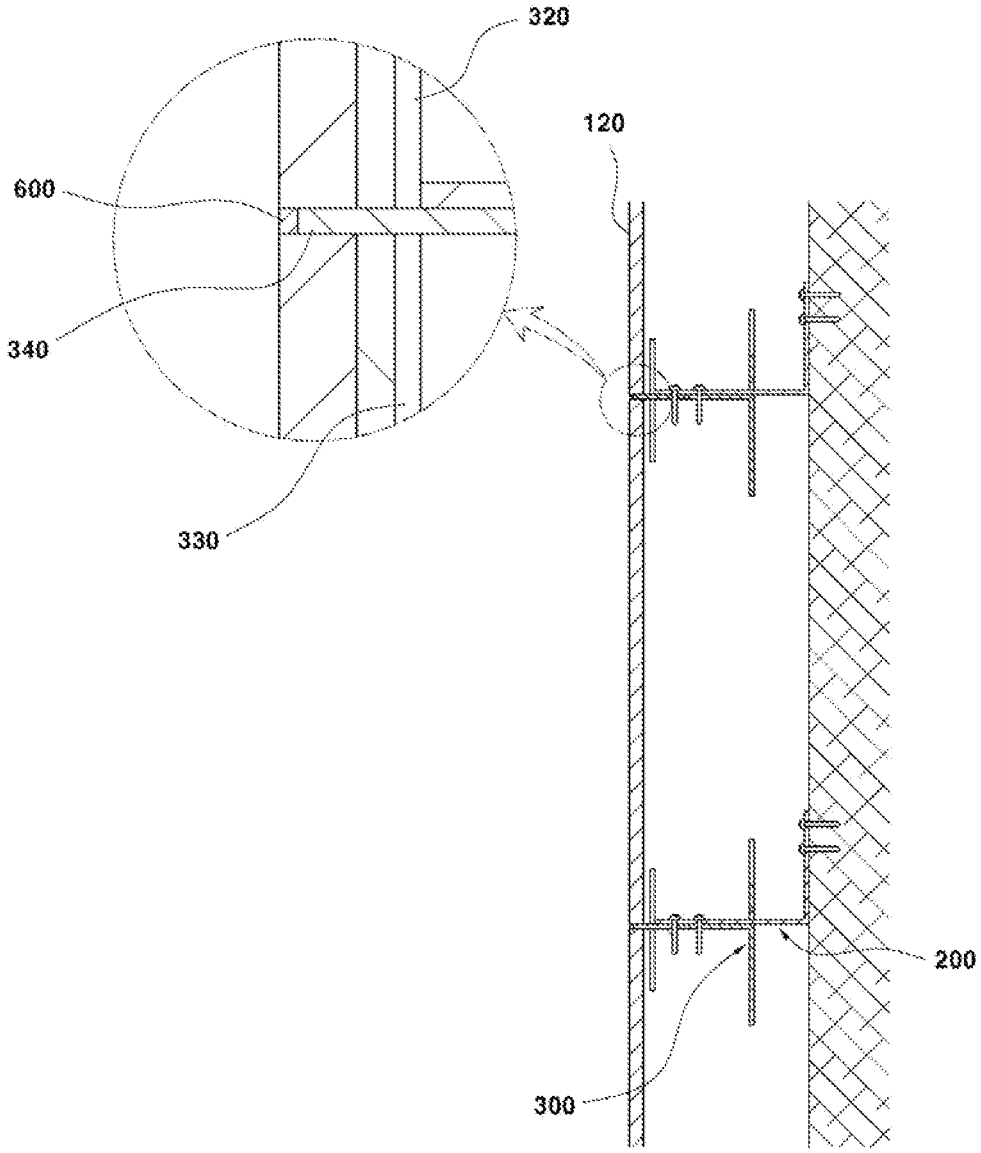
FIG. 5 is a cross sectional view showing a state that a stone plate is supported between elongated support portions of a bracket according to the present invention.

Looking closely at this type of construction, the stone plate 120 of stone insulating panel is inserted and supported between the extending support portion 340 of the upper bracket and the extending support portion 340 of the lower bracket that adjoin upward and downward, as shown in FIG. 4. Therefore, as shown in FIG. 5, it is possible to prevent safety accidents because the stone plates do not fall even if the insulating boards are completely destroyed by fire.

Figure 6:
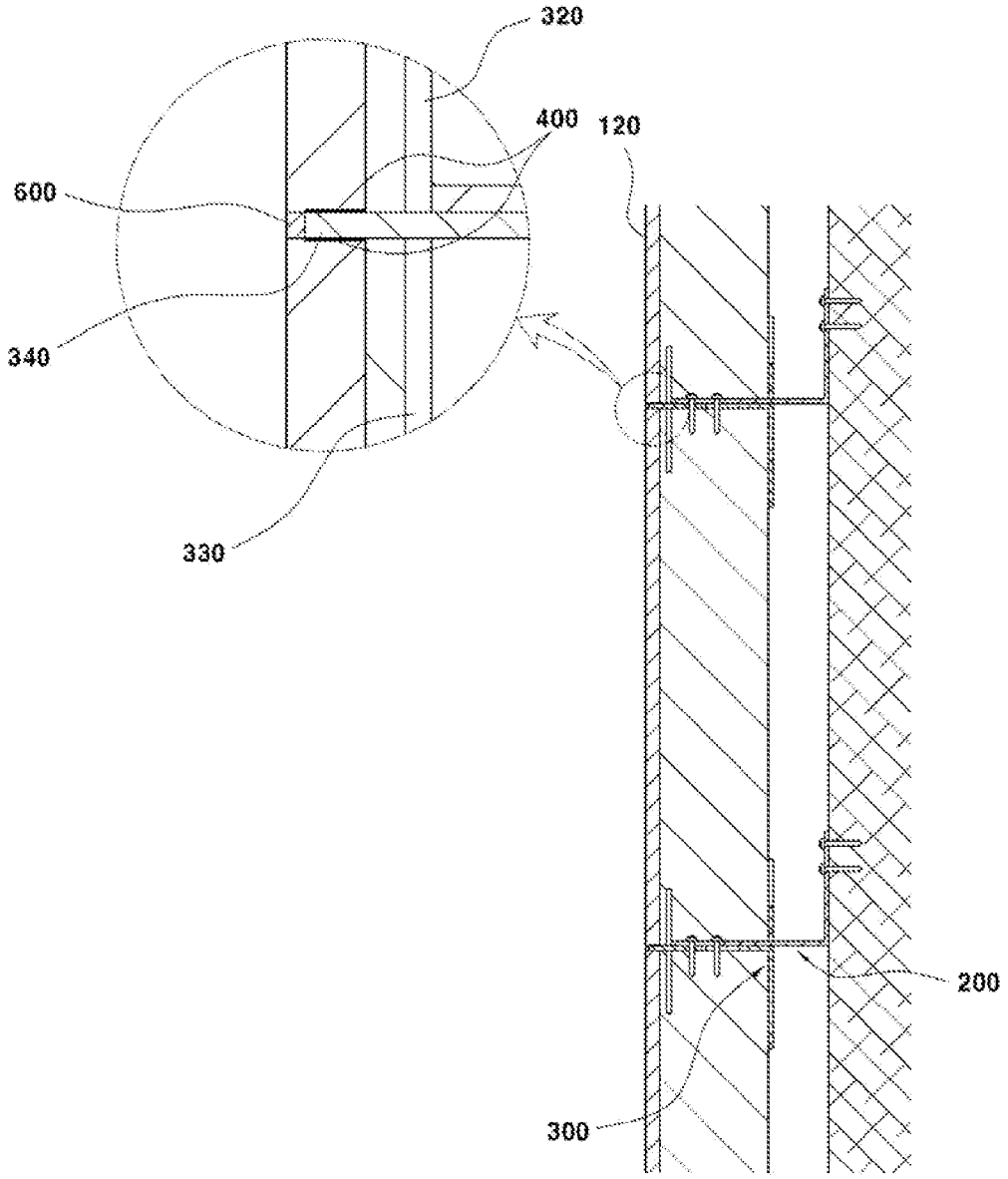
FIGS. 6 and 7 are cross sectional views showing another embodiment of the present invention, respectively.

To make the stone plate 120 be supported more firmly between the extending support portions 340, the extending support portion 340 and the stone plate 120 are made to attach using the adhesives 400 as shown in FIG. 6.

Figure 7:
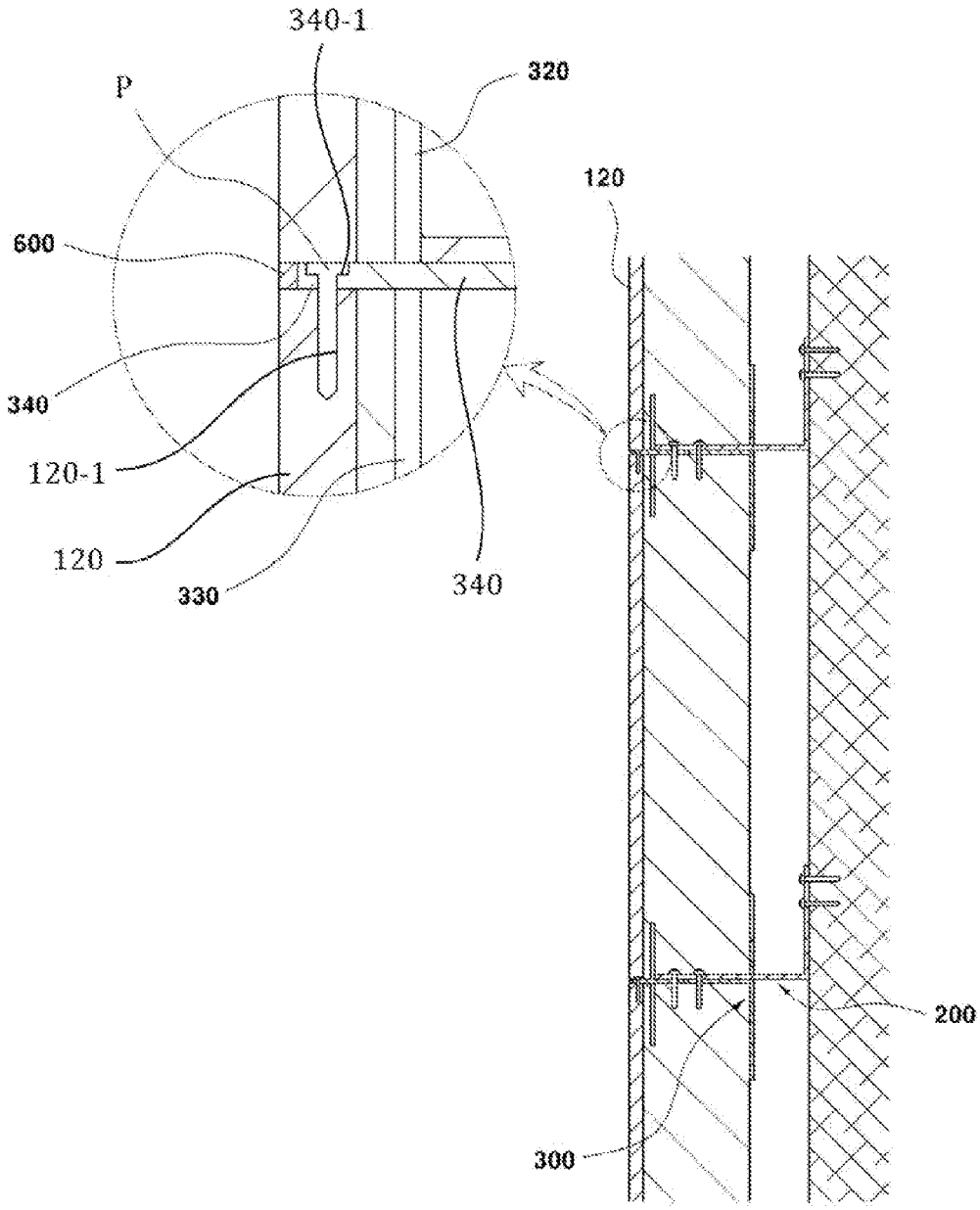

Further, as shown in FIG. 7, insert holes 120-1 are formed respectively in the upper end portion and lower end portion of the stone plates 120 and a through hole 340-1 is formed in the extending support portion 340. When an insert pin P is passed through the through hole 340-1, and inserted and fixed into the insert hole 120-1, it is possible to make the stone plates 120 be firmly supported between the extending support portions 340.

Meanwhile, finish caulking 600 is applied to a gap between the upper stone insulating panel 100 and the lower stone insulating panel 100 for finishing.

According to the present invention described above, it is possible to provide a lightweight stone insulating panel that is simple to construct, because the stone plate attaching process and the insulating process can be carried out all at once during building exterior finishing by forming the insulated board and the reinforcing board integrally on the stone plate.

[Industrial Applicability]

The present invention can provide a lightweight stone insulating panel in which an insulating board and a reinforcing board are integrally formed in a stone plate, so that the construction work is simple as a stone plate attaching process and an insulating process can be carried out all at once.

The invention claimed is:

1. A construction method for insulating a building exterior using a lightweight stone insulating panel, the construction method comprising the processes of:

fixing an L-shaped anchor (200) provided with a vertical portion (210) and a horizontal portion (220) on a building exterior wall, the horizontal portion (220) having a first coupling hole (221);

fixing a bracket (300) to the horizontal portion (220) of the L-shaped anchor (200), the bracket (300) comprising a horizontal support portion (310) having a second coupling hole (311), an upward fixing portion (320) bent upward from a front end of the horizontal support portion (310), a downward fixing portion (330) bent downward from the front end of the horizontal support portion (310), an extending support portion (340) extending forward from the front end of the horizontal support portion (310), an upward support portion (350) bent upward at a rear end of the horizontal support portion (310) and having a slit (351) in which the horizontal portion (220) of the L-shaped anchor (200) is inserted, and a downward support portion (360) bent downward at the rear end of the horizontal support portion (310), wherein said fixing a bracket (300) to the horizontal portion (220) includes: i) passing the horizontal portion (220) through the slit (351), and ii) inserting a coupling pin (10) into the first coupling hole (221) and the second coupling hole (311) such that the coupling pin (10) passes through the horizontal portion (220) and the horizontal support portion (310); and fixing a plurality of lightweight stone insulating panels (100) to the building exterior wall using the bracket (300), the plurality of lightweight stone insulating panels including a first panel positioned above the bracket (300) and a second panel positioned under the bracket (300), each panel comprising an insulating board (110), a stone plate (120) attached to a front surface of the insulating board (110), and a reinforcing board (130) attached to a rear surface of the insulating board (110), wherein said fixing a plurality of lightweight stone insulating panels (100) includes:

loading a lower end portion of the insulating board (110) of the first panel on the upward fixing portion (320) of the bracket (300) in a state that a rear lower end of the reinforcing board (130) of the first panel is supported on the upward support portion (350);

inserting the upward fixing portion (320) of the bracket (300) into the lower end portion of the insulating board (110) of the first panel;

loading an upper end portion of the insulating board (110) on the downward fixing portion (330) of the bracket (300) in a state that a rear upper end of the reinforcing board (130) of the second panel is supported on the downward support portion (360);

inserting the downward fixing portion (330) of the bracket (300) and the coupling pin (10) into the upper end portion of the insulating board (110) of the second panel; and supporting the stone plate (120) by the extending support portion (340).

2. The construction method according to claim 1, wherein the stone plate (120) and the reinforcing board (130) are attached to of the insulating board (110) by urethane adhesives, the insulating board (110) is selected from EPS, an urethane board, a rock wool board or a glass wool board, and the reinforcing board (130) is selected from a magnesium board, a cement board, or a gypsum board.

3. The construction method according to claim 1, wherein the extending support portion (340) and the stone plate (120) are attached to each other with adhesives.

4. The construction method according to claim 1, further comprising:

forming an insert holes (120-1) in an upper end portion of the stone plates (120) of the second panel;

forming a through hole (340-1) in the extending support portion (340);

passing an insert pin (P) through the through hole (340-1); and inserting and fixing the insert pin (P) in the insert hole (120-1).

* * * * *